United States Patent [19]

Pancook et al.

[11] 3,937,113

[45] Feb. 10, 1976

[54] PUNCHING APPARATUS

[75] Inventors: James J. Pancook, Tonawanda; Ralph L. Weisbeck, Williamsville, both of N.Y.

[73] Assignee: Unipunch Products, Inc., Buffalo, N.Y.

[22] Filed: Mar. 5, 1974

[21] Appl. No.: 448,334

[52] U.S. Cl. ..... 83/400; 83/564; 83/588; 83/590

[51] Int. Cl.[2] ..... B26D 5/16

[58] Field of Search ..... 83/399, 400, 564, 588, 83/590, 698, 699, 552; 29/568

[56] References Cited

UNITED STATES PATENTS

| | | | |
|---|---|---|---|
| 931,431 | 8/1909 | Kilgore | 83/400 |
| 2,892,500 | 6/1959 | Baron et al. | 83/399 X |
| 3,039,344 | 6/1962 | Herick | 83/699 X |
| 3,174,378 | 3/1965 | Friedland et al. | 83/552 X |
| 3,225,636 | 12/1965 | Schott et al. | 83/468 |
| 3,234,839 | 2/1966 | Smeets | 83/588 X |
| 3,638,523 | 2/1972 | Yasuda et al. | 83/698 X |
| 3,745,646 | 7/1973 | Kristiansson | 83/564 |

*Primary Examiner*—J. M. Meister
*Assistant Examiner*—Fred A. Silverberg
*Attorney, Agent, or Firm*—Stanley J. Price, Jr.

[57] ABSTRACT

A press frame includes upper and lower arm portions forming a recess therebetween for receiving a workpiece that is supported by a worktable mounted on the lower arm portion. A ram housing is supported at the front of the upper arm portion and is provided with a ram punch connected to a power source for reciprocating the ram toward and away from the worktable. A swing arm is connected to the upper arm portion in the recess of the press frame by a vertical shaft and is arranged to pivot in a horizontal plane with respect to the upper arm portion with the shaft. A tool holder is releasably engaged to the end of the swing arm by a locking device and is provided with a vertical bore for receiving a punch tool. A cooperating die is supported in the worktable, and when the tool holder and the swing arm are positioned in punching position, the punching tool is vertically aligned between the ram and the die so that the tool holder vertically guides the punch tool toward and away from the die as the ram delivers an impact blow to the punch tool. A fluid actuated device rigidly retains the swing arm and the attached tool holder in punching position with respect to the die. When the swing arm is locked in punching position, the punch circuit is completed and thereafter is selectively energized either manually or automatically to initiate a punching stroke of the ram. To facilitate a tool and die change, the fluid actuated device operably releases the swing arm from engagement with the upper arm portion permitting the swing arm to pivot laterally in a horizontal plane out of punching position. The punching apparatus is rendered inoperable until the swing arm is returned to punching position with the die.

41 Claims, 9 Drawing Figures

PUNCHING APPARATUS

BACKGROUND OF THE INVENTION

1. Field of the Invention

This invention relates to an apparatus for perforating a workpiece having a horizontally positioned arm member that is pivotally connected to a press frame and is arranged to individually receive a series of tool holders that are interchangeably attached to the swing arm, and more particularly to a punching apparatus operable to provide vertical reciprocal movement of a punch tool only when the horizontal arm member and attached tool holder are located in punching position with respect to the press frame.

2. Description of the Prior Art

Conventional machines for perforating sheet metal include a worktable supported by the lower portion of a press frame with a ram punch positioned vertically above the worktable in the upper portion of the press frame. A suitable punching tool is positioned below the ram punch above the workpiece and is arranged to move vertically toward and away from a die which is rigidly supported in the table. Examples of conventional punching machines and tool supporting structures are illustrated in U.S. Pat. Nos. 3,225,636, 3,246,554, 3,269,241, 3,270,605, 3,405,581, 3,456,542 and 3,779,113.

U.S. Pat. No. 3,270,605 discloses a clamping mechanism by which the tool support is releasably engaged to the upper arm of the frame. By manually releasing a hand lever, a hook acting through a cam means is movable into and out of engagement with a support pin of the tool support. The clamping mechanism is integral with the upper arm of the machine frame and thus remains fixed relative thereto for detachably receiving the tool support.

A carriage assembly for supporting a tool support holder of a punching machine is illustrated and described in U.S. Pat. No. 3,405,581. The carriage is rotatably mounted by antifriction rollers on a pair of parallel spaced rails which are positioned parallel to the longitudinal axis of the frame upper arm portion. The tool support holder is releasably locked to the carriage assembly and movable therewith between an extended and retracted position in which the carriage travels horizontally on the rails in a front-to-rear direction relative to the upper arm portion.

In U.S. Pat. No. 3,456,542 horizontally and vertically acting clamps secure a detachable tool support to the press frame upper arm. The clamps are rigidly carried by the press frame upper arm and are manually operable to engage and release vertical pins disposed in slots of the tool support. The clamps pivotally support the tool support which is moved into and out of operating position on the upper arm. However, the clamps remain fixed on the upper arm as the tool support is pivoted relative to the clamps.

There is need for a punching apparatus that has a tool support releasably engaged to the upper arm of the press frame and also pivotally connected to the frame upper arm for moving the punch tool into and out of punching relation with respect to the ram and die to facilitate efficient and rapid exchange of the punch tool in the tool support and die in the worktable.

SUMMARY OF THE INVENTION

In accordance with the present invention, there is provided punching apparatus including a press frame and an elongated table horizontally mounted on the frame for supporting a workpiece to be perforated. The press frame has an arm member positioned above the upper surface of the table and extends thereacross. The arm member is spaced from the table forming an elongated recess therebetween for receiving the workpiece supported on the table. A ram is supported for relative vertical movement by the front end portion of the press frame arm member. A power source is connected to the ram and provides for vertical reciprocation of the ram toward and away from the table. A die support mounted in the table is positioned in vertical underlying relationship with the ram. A tool support arm having a tool support portion is pivotally connected to the press frame arm member between the press frame arm member and the table. The tool support arm and the tool support portion are laterally movable in a horizontal plane relative to the press frame from a first position vertically aligned with the ram and the die support to a second position displaced laterally from vertical alignment with the ram and the die support. A fluid actuated piston cylinder assembly is provided in the press frame arm member and is operable to extend and retract a connecting pin by which the tool support arm is rigidly engaged to the arm member and thereby located in punching position so that downward reciprocation of the ram urges the punch tool in the tool support portion into engagement with the die support to thus perforate the workpiece.

The tool support arm is pivotally connected by a vertical shaft to the arm member of the press frame. A locking device secures the tool support portion to the opposite end of the tool support arm. When a tool and die change is to be made, the tool support arm is released from engagement with the press frame arm member, and the tool support arm is then pivoted laterally from punching position below the press frame arm member. The tool support portion is interchangeably attached to the tool support arm by operation of the locking device to thereby permit an exchange of the tool support portion in order to accommodate a different size punch tool.

The actuated actauted piston cylinder assembly is provided with an extensible piston rod having a pin member secured to the end portion thereof. The cylinder includes a first inlet port for receiving fluid under pressure which extends the rod outwardly from the cylinder to move the pin vertically downwardly through a bore in the press frame arm member into an aligned bore of the tool support arm. In this manner, the tool support arm is rigidly connected to the press frame arm member when the tool support portion is positioned in vertical alignment with the ram. The extended pin closes a normally open electrical switch in the tool support arm to complete the punch circuit. The punch circuit is then energized manually by actuating a foot switch or automatically by actuating a switch associated with a duplicating mechanism to effect reciprocation of the ram and movement of the punch tool toward and away from the dies supported in the table. In this fashion, perforations are made in the workpiece. Unless the pin is extended into the tool support arm when the tool support portion is vertically aligned with the die and ram, the punching circuit is broken, and, consequently, the punching apparatus is rendered inoperable.

Accordingly, the principal object of the present invention is to provide punching apparatus for perforating a workpiece having a tool support arm that is pivotally connected to the frame of the apparatus and includes a tool support portion which is interchangeably attached to the end of the tool support arm by which individual tool support portions, varying in size, may be efficiently and selectively exchanged on the tool support arm to provide a versatile punching operation.

Another object of the present invention is to provide punching apparatus capable of perforating a workpiece by vertical reciprocating movement of a punch tool that is pivotally connected to the frame of the apparatus and easily moved into and out of punching relationship with a ram to facilitate exchange of the punch tool and die.

Another object of the present invention is to provide apparatus for perforating a workpiece which includes a tool holder for guiding the punch tool in its vertical reciprocating movement toward and away from the die and is quickly and efficiently releasable from engagement with the punching apparatus to facilitate a tool change.

Another object of the present invention is to provide punching apparatus operable to provide vertical reciprocation of a punch tool into and out of punching engagement with a workpiece only when the punch tool is arranged in vertical alignment with the die.

Still another object of the present invention is to provide punching apparatus having a tool holder connected to the end portion of a swing arm that maintains the tool holder in punching relationship with the die by the operation of a fluid actuating locking device.

A further object of the present invention is to provide punching apparatus having a swing arm that includes an interchangeably attached tool holder and is pivotally connected to the frame of the punching apparatus in such a manner to permit removal of the swing arm with attached tool holder as a single unit from connection to the frame.

These and other objects and advantages of this invention will be more completely described and disclosed in the following specification, the accompanying drawings and the appended claims.

DESCRIPTION OF THE PREFERRED EMBODIMENTS

Figure 1:
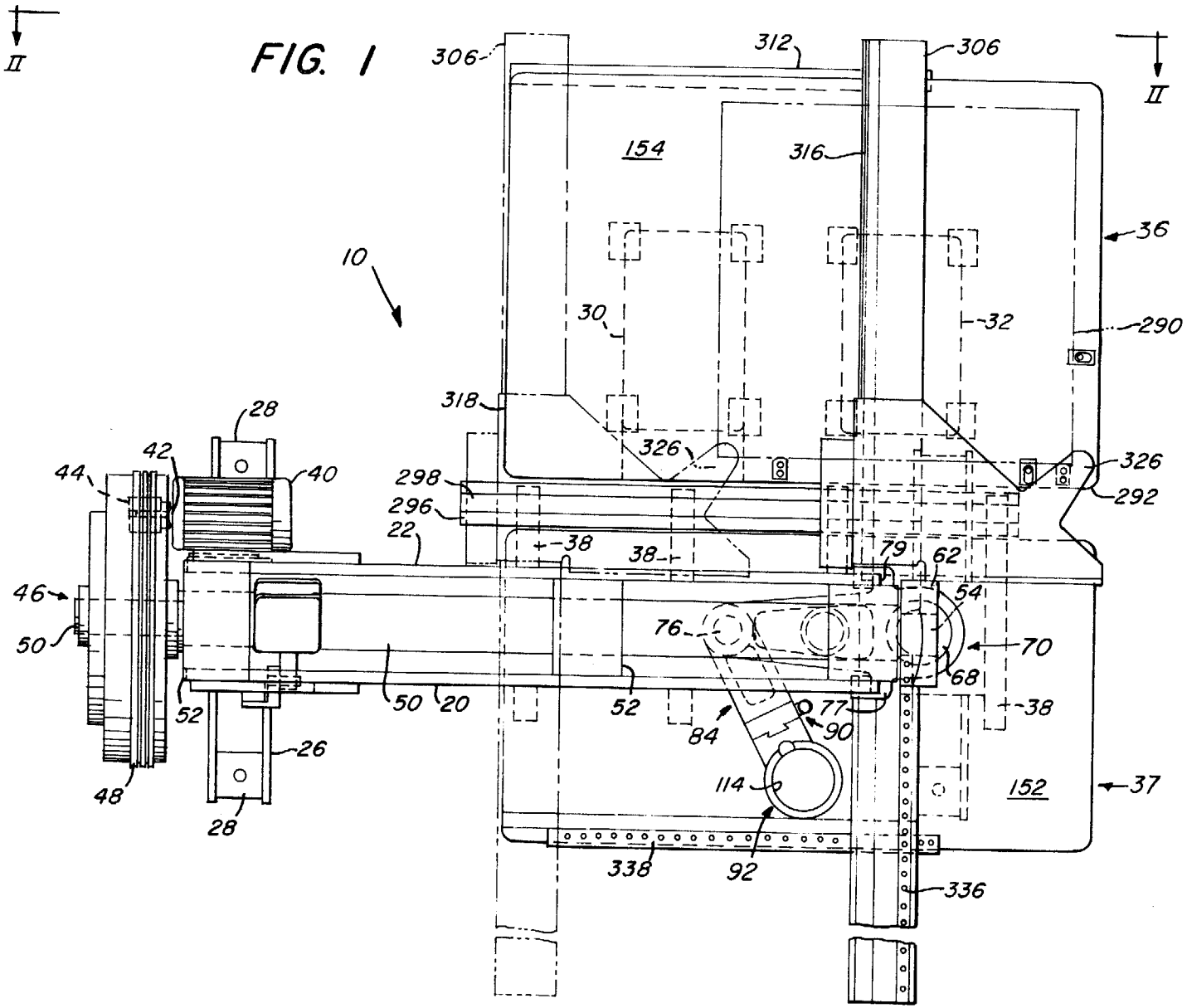
FIG. 1 is a top plan view of the punching apparatus, illustrating a swing arm with attached tool holder displaced from a punching position on the worktable.
Figure 2:
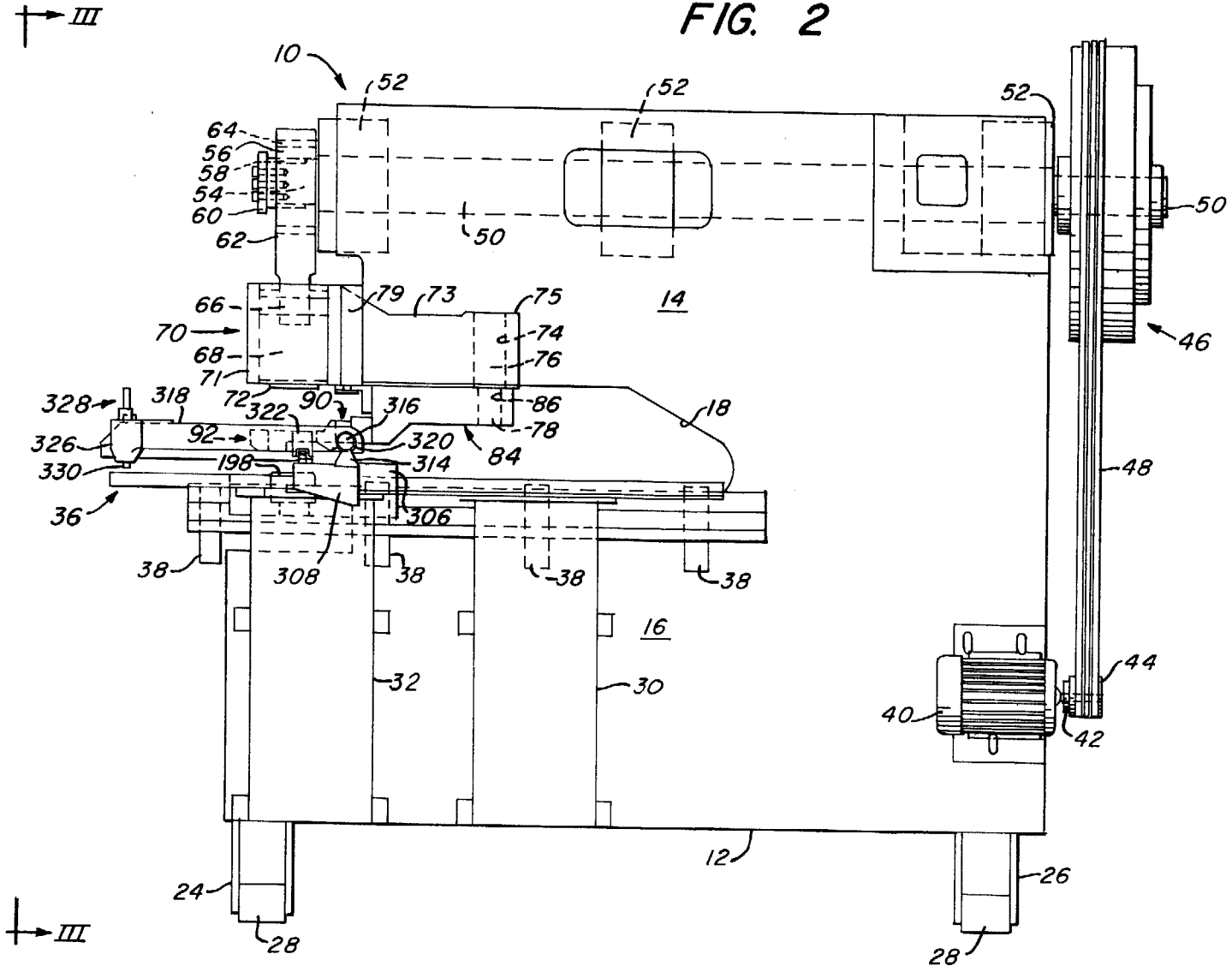
FIG. 2 is a view in side elevation taken along the line II—II of FIG. 1, illustrating the swing arm with attached tool holder positioned in punching relation with the ram punch and the die holder that is supported on the table.
Figure 3:
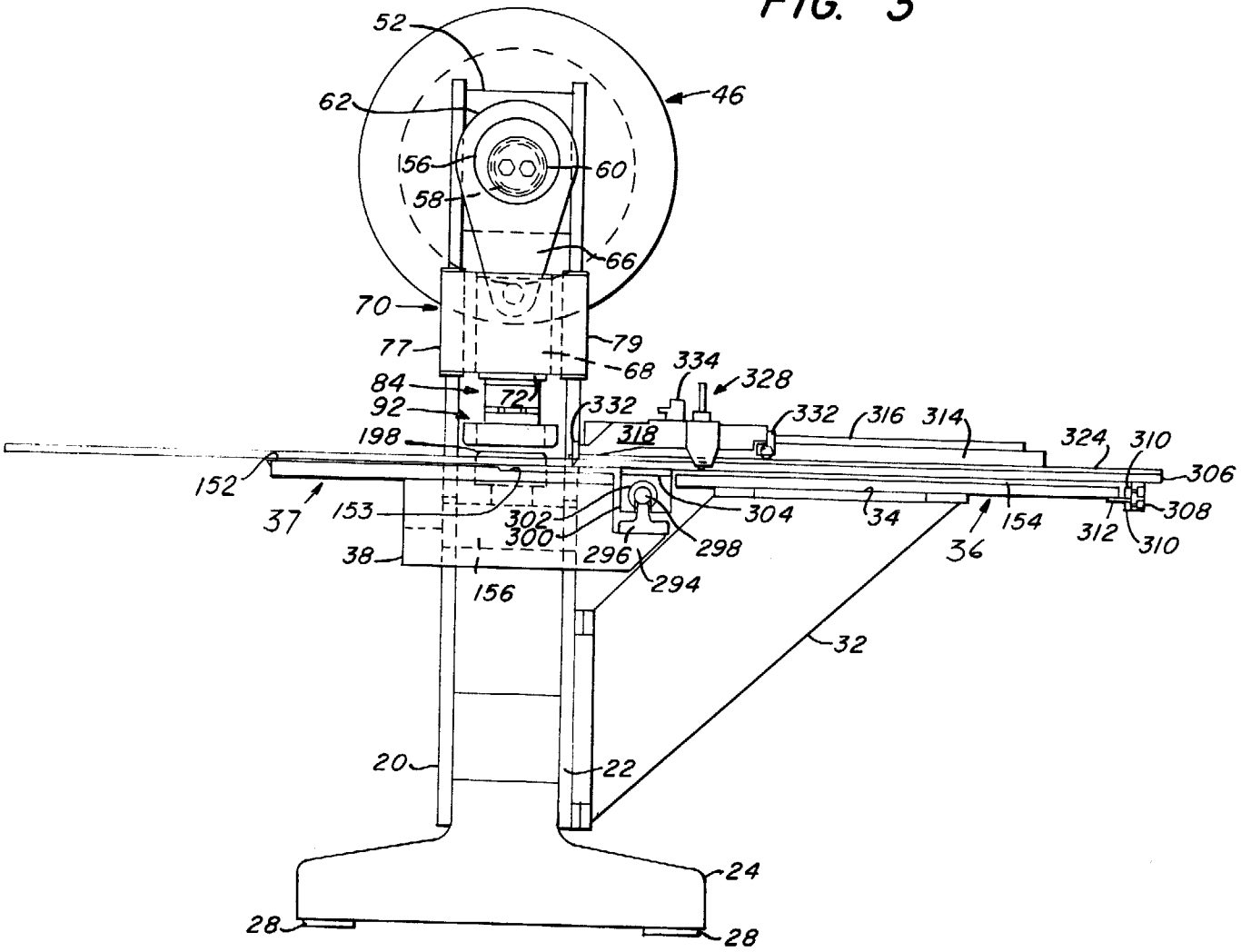
FIG. 3 is a view in front elevation taken along the line III—III of FIG. 2.

Referring to the drawings and more particularly FIGS. 1–3, there is illustrated a punching apparatus generally designated by the numeral 10 for perforating a suitable workpiece. The punching apparatus 10 includes a press frame 12 of a C-shaped construction having an upper arm portion 14 and a lower arm portion 16 which together form an elongated recess or throat 18 for receiving the workpiece.

The press frame 12 includes a pair of parallel opposed vertical stiffener plates 20 and 22 that are rigidly supported at their lower end portions to the legs 24 and 26. The legs 24 have feet 28 which support the press frame 12 on the floor. A pair of upwardly extending side table supports 30 and 32 are rigidly secured to the bottom portion of the stiffener plate 22 and form a horizontal top surface 34 upon which is positioned a table 36 for supporting a template used when the workpiece is to be perforated in accordance with the hole pattern of the template. A second table 37 is horizontally supported by table supports 38 which are bolted to the press frame 12 and extends into the throat 18. Thus, the table 37 is arranged for supporting in the throat 18 a workpiece to be perforated in a manner hereinafter described.

An electric motor 40 is mounted on the rear of the press frame 12 and is provided with a drive shaft 42 upon which a pulley 44 is secured. Rotation of the pulley 44 with shaft 42 is transmitted to the fly wheel assembly generally designated by the numeral 46 by the belts 48. The fly wheel assembly 46 is non-rotatably secured to the end of a crankshaft 50 which is, in turn, rotatably mounted in bearing blocks 52 in the upper end portion of the press frame upper arm 14. The shaft 50 extends the length of the press frame 12 and has a spindle end portion 54 that projects beyond the bearing block 52 at the front end of the upper arm portion 14.

Figure 4:
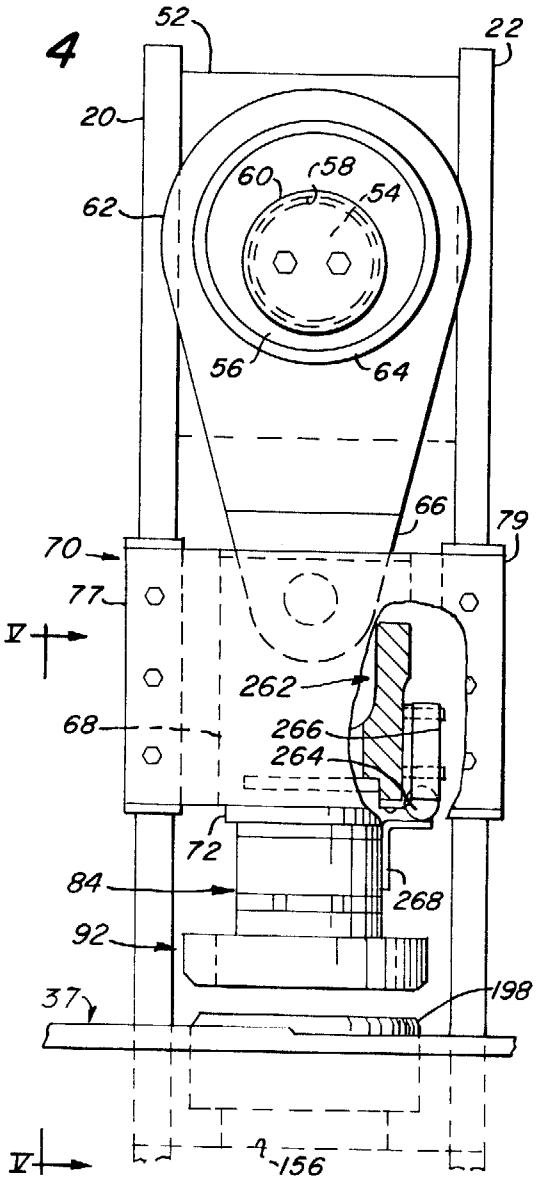
FIG. 4 is an enlarged fragmentary view partially in section, illustrating the pitman for connecting the crankshaft and eccentric cam to the ram punch for reciprocating the ram punch toward and away from the tool holder and the cam operated valve for deenergizing the punch circuit.

As illustrated in FIGS. 2, 3 and 4, an eccentric cam 56 is mounted on the spindle portion 54 and is provided with a recess for receiving a locking ring 58 which surrounds the spindle 54. The locking ring projects outwardly beyond the end portion of the spindle 54 and a face plate 60 positioned on the locking ring 58 is bolted to the spindle 54. With this arrangement, tightening of the bolts in the face plate 60 urges the locking ring 58 on the spindle 54 into rigid engagement with the eccentric cam 56. Thus, rotation of the crankshaft 50 and spindle 54 is transmitted to the eccentric cam 56. Loosening the bolts of the face plate 60 permits relative rotation between the crankshaft 50 and the eccentric cam 56.

Figure 7:
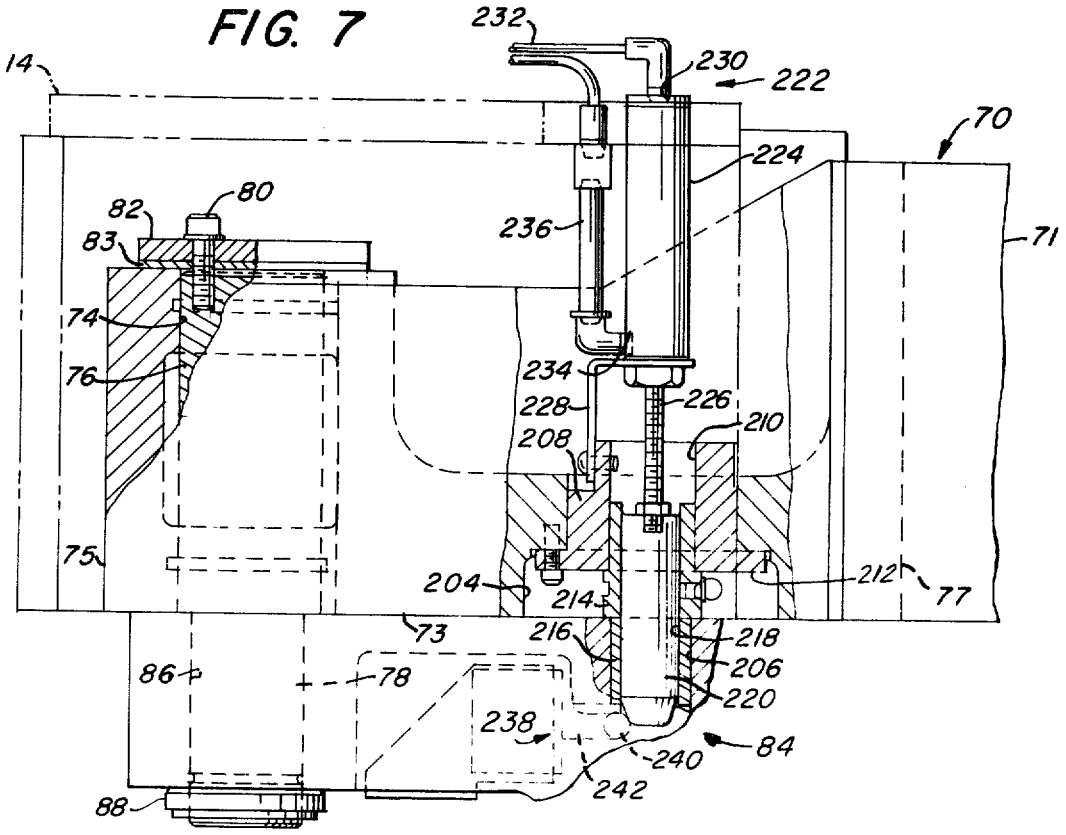
FIG. 7 is a fragmentary view in side elevation and partially in section, illustrating the pivotal connection of the swing arm to the upper arm portion of the press frame and a fluid actuated piston cylinder assembly for rigidly engaging the swing arm to the upper arm portion of the press frame.

A pitman 62 is supported on the eccentric cam 56 by pitman bearing 64. The pitman 62 includes a lower arm 66 that is suitably connected to a ram punch 68. The ram punch 68 includes a striker plate 72 on the bottom surface thereof. With the above described arrangement rotation of the crankshaft 50 is converted into rectilinear reciprocal motion by the eccentric cam 56 to thereby vertically reciprocate the ram punch 68 and thus produce a punching action. As illustrated in FIGS. 2 and 7, the ram punch 68 has a cylindrical configuration and is slidably mounted in a ram housing generally designated by the numeral 70. The ram housing 70 has a front portion 71, an intermediate portion 73 and a rear portion 75. A pair of flanges 77 and 79 extend outwardly from the ram housing intermediate portion 73 and are bolted to the front edges of stiffener plates 20 and 22. The ram housing rear portion 75 has a vertical bore 74 therethrough with washer bearings for rotatably supporting a shaft 76 having an end portion 78 of reduced diameter. The shaft 76 is rotatably supported in the bore 74 by bolts 80 that extend through a cap 82 and a thrust washer 83. The bolts are threadedly engaged to the shaft 76. With this arrangement the shaft 76 together with the cap 82 and thrust washer 83 are permitted to rotate in the bore 74 of the ram housing 70.

Referring to FIGS. 2 and 7, there is illustrated a swing arm generally designated by the numeral 84 positioned below the ram housing 70 with a vertical bore 86 in the rear portion thereof for nonrotatably receiving the reduced lower end portion 78 of the shaft 76 rotatably mounted in the ram housing 70. A lock nut 88 is threadedly engaged to the end portion 78 of shaft 76 and nonrotatably secures the swing arm 84 on the lower end portion 78 of shaft 76 to thus permit pivotal movement of the swing arm 84 in a horitonztal plane relative to the ram housing 70.

Figure 5:
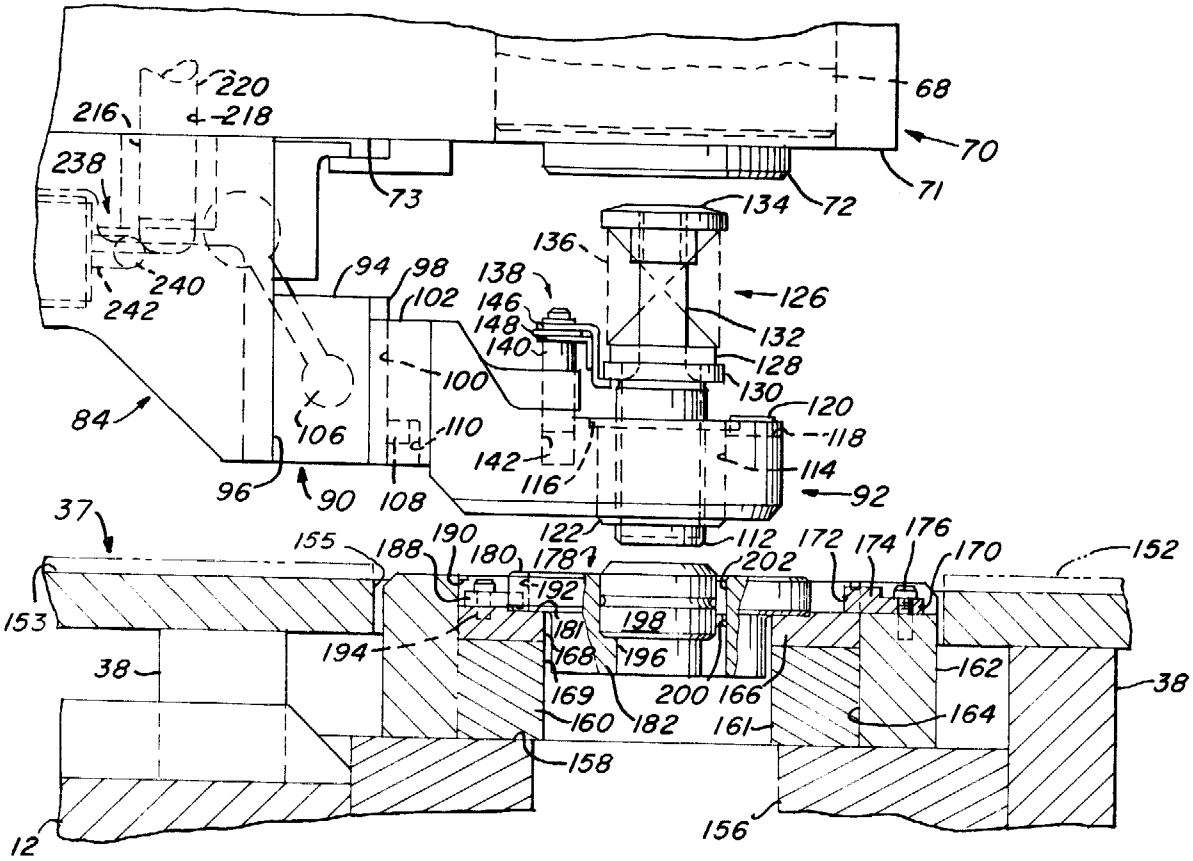
FIG. 5 is an enlarged fragmentary view in side elevation taken along the line V—V of FIG. 4, illustrating a suitable punching tool retained in the tool holder and the cooperating die supported on the worktable.
Figure 6:
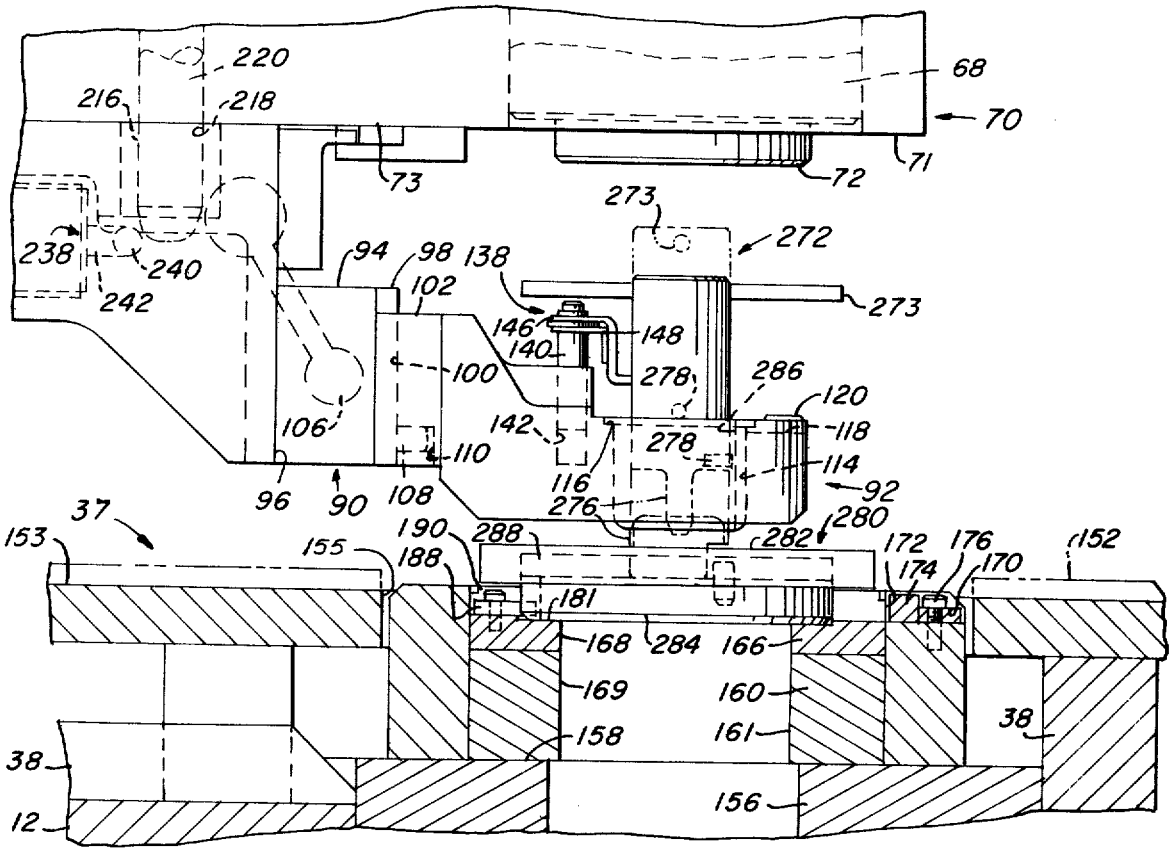
FIG. 6 is a view similar to FIG. 5, illustrating the indexing apparatus for orienting the tool holder with the die support mounted in the worktable.
Figure 8:
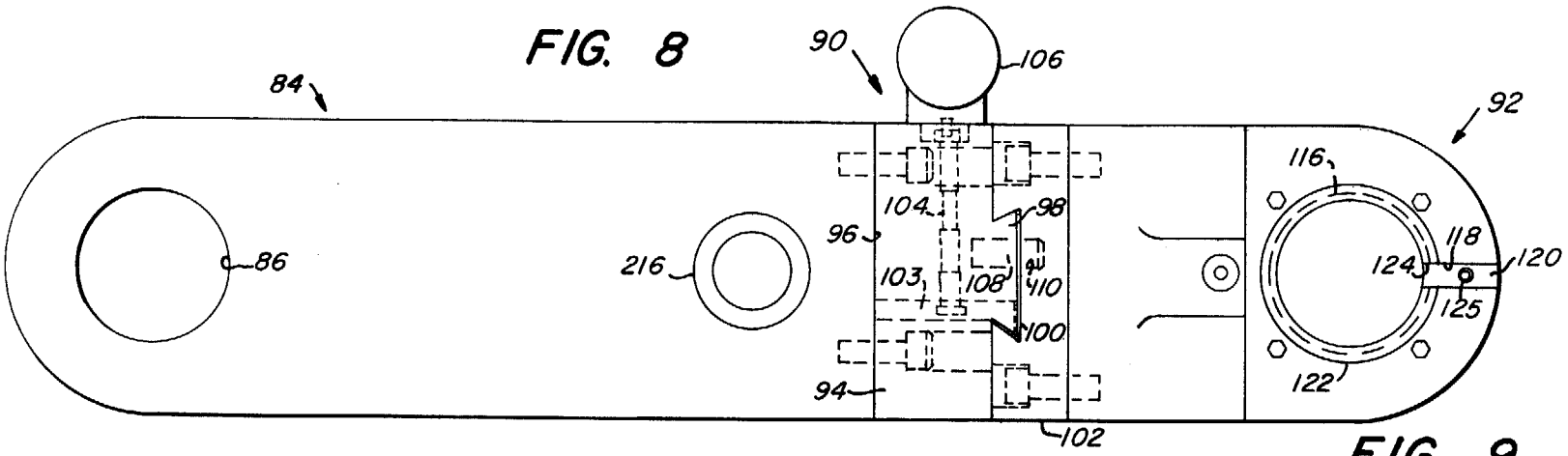
FIG. 8 is a fragmentary plan view of the swing arm, illustrating a locking device for releasably engaging the tool holder to the swing arm.

In FIGS. 5, 6 and 8 the swing arm 84 is connected to a tool holder 92 by a locking device generally designated by the numeral 90. As illustrated in detail in FIG. 8, the locking device 90 includes a body portion 94 which is rigidly bolted to the front face 96 of swing arm 84. The body portion 94 is provided with a dovetail 98 which is received within a dovetail recess 100 of a bar 102 that is bolted to the rear portion of the tool holder 92.

The body portion 94 has a shoe 103 and a rotatable cam 104 connected to a locking handle 106. Rotation of the locking handle 106 rotates the cam 104 and urges the shoe 103 away from the locking bar 102 to frictionally engage the body portion 94 front surface and portions of the dovetail 98 to the locking bar rear surface and portions of the dovetail recess 100. In addition, the body portion 94 is provided with a dowel pin 108 which projects outwardly from the dovetail 98 and is arranged to engage a recess 110 in the locking bar 102 and serve as a stop when the dovetail 98 is properly located in the recess 106. With this arrangement, the tool holder 92 is securely attached to the swing arm 84 by the engagement of the body portion 94 to the bar 102. The locking device 90 provides for quick and efficient changing of tool holders on the swing arm 84 for accommodating tools of various shapes and sizes. The details of the locking device 90 are described in U.S. Pat. No. 3,107,562.

The above described arrangement of the swing arm 84 with the attached locking device 90 and tool holder 92 constitutes a single unitary assembly which may be easily removed from connection to the upper arm portion 14 by removing the lock nut 88 from engagement with the end portion 78 of shaft 76 to permit release of the swing arm 84 from the end portion 78. In this manner, the entire assembly may be easily and efficiently removed from the punching apparatus for servicing, replacement of parts and the like.

Punching tool 112 is shown supported in the tool holder 92 in FIG. 5. To receive the punching tool 112 the tool holder 92 is provided with a circular bore 114 having an upper annular recess 116. The annular recess 116 has a horizontal keyway 118 positioned at the front end portion of the tool holder 92 for receiving a key 120. A guide bushing 122 is positioned in the bore 114 and is provided with a slot 124 at its peripheral edge, as illustrated in FIG. 8. The slot 124 is aligned with the keyway 118 for receiving the key 120 which is secured to the tool holder by the key retaining screw 125. In this manner the guide bushing 122 is non-rotatably positioned within the tool holder 92.

The punching tool 112 is slidably positioned within the guide bushing 122 and includes at its upper end portion a stripping assembly generally designated by the numeral 126. The stripping assembly 126 includes a spacer 128 mounted on a shoulder 130 of the punching tool 112. A shank 132 extends upwardly from the shoulder 130 and is provided at its upper end portion with a punch head 134. A stripping spring 136 surrounds the shank 132 and acts against spacer 128 and the punch head 134. Downward movement of the ram punch 68 imparts an impact blow through the striker plate 72 upon the punch head 134 to move the punching tool 112 vertically downwardly in the guide bushing 122 to engage the workpiece positioned on the table 37. When the punching stroke has been completed the ram punch 68 returns to the position illustrated in FIG. 5. In a well known manner the stripping spring 136, compressed between the punch head 134 and the spacer 128 on the shank 132, retracts the punching tool 112 from the workpiece into the guide bushing 122.

A lifter assembly generally designated by the numeral 138 is mounted on a lifter shaft 140 that is positioned in a bore 142 of the tool holder 92. The lifter shaft 140 supports a lifter 146 and a lifter arm clip 148. The lifter arm 146 includes a lip portion 150 positioned in abutting contact with the lower edge of the shoulder 130 on the punching tool 112. With this arrangement the lifter assembly 138 acts between the tool holder 92 and the punch tool 112 to lift the tool 112 and the stripping spring 136 from the workpiece. Thus, the tool holder 92 and the guide bushing 122 together with the lifter assembly 138 and the stripping assembly 126 serve to maintain vertical alignment of the punching tool 112 in the guide bushing 122 with none of the punching force transmitted to the tool holder 92.

Referring to FIGS. 3 and 5, the structure for supporting the workpiece on the table 37 is illustrated in which the table 37 includes an upper supporting surface 152 and a lower surface 153. The table 36 has a surface 154 which supports the template and is maintained in coplanar relationship with the surface 153 of table 37. The elevation of surface 152 is greater than that of surfaces 153 and 154 by an amount which provides clearance between the bottom of the workpiece and the top of the template when the workpiece is positioned on surface 152 and the template on surface 154.

The table 37 is maintained in horizontal position relative to the swing arm 84 on the table supports 38 which are secured to the press frame 12. The table 37 is provided with an opening 155 vertically aligned below the ram punch 68. A die block 156 is positioned beneath the opening 155 and is rigidly retained therein by the press frame 12 and the table support 38. The die block 156 has a horizontal surface 158 upon which is positioned an annular die support 160 having a bore 161 extending therethrough. Surrounding the die support 160 and also supported on the die block horizontal surface 158 is a die pedestal 162 which extends through the opening 155.

The die pedestal 163 is positioned within the opening 155 and is non-rotatably mounted by bolts (not shown) to the die block 156. The die support 160 is concentrically positioned within bore 164 of the die pedestal 162. A die index ring 166 having a bore 168 is coaxially positioned on the top surface of the die support 160 within the die pedestal 162. The die index ring bore 168 is vertically aligned with the die support bore 161 to provide a central opening 169 in the table 37.

A horizontally positioned keyway 170 is cut in the periphery of the die pedestal 162 and is aligned with a horizontal keyway 172 in the die index ring 166. A key 174 is received in the aligned keyways 170 and 172 and together with the key retaining screw 176, extending through the key 174 into the die pedestal 162, serve to non-rotatably secure the die pedestal 162 to the die index ring 166. To facilitate the positioning of small sized dies in the die index ring 166, such as shown in FIG. 5, a die adapter 178 is positioned within the opening 169 provided by the aligned bores 161 and 168. The die adapter 178 includes an annular ring portion 180 which is received in the die index annular recess portion 181. A longitudinal body portion 182 extends through the aligned bores 161 and 168 of the die index ring 166 and the die support 160 respectively as shown in FIG. 5.

The die adapter 178 in non-rotatably retained on the die index ring 166 by a key 188 which is aligned with horizontally positioned keyways 190 and 192 of the index ring 166 and the die adapter 178 respectively. A key retaining screw 194 secures the key 188 within the aligned keyways 190 and 192 to thereby prevent angular movement of the die adapter 178 relative to the die index ring 166.

The die adapter 178 is provided with axial bore 196 in which is received a die 198 corresponding to the punch tool 112. Angular movement of the die 198 within the die adapter 178 is limited by the key 200 positioned in the keyway 202 of the die adapter 178. With the above described arrangement, the die 198 is rigidly supported in the worktable 36 and aligned with the ram punch 68 to receive the punching tool 112 during the punching operation. The punching tool and die support arrangement illustrated in FIG. 5 accommodates tool and coordinating dies of various shapes and sizes which are easily and efficiently exchanged to provide a versatile punching apparatus capable of performing numerous perforating operations such as punching, blanking, notching nibbling and the like.

To effect an exchange of the tool and die combination illustrated in FIG. 5 for a larger tool and die combination, the die adapter 178 is released from engagement with the die index ring 166 in the annular recess 181 and together with die 198 is removed from the central opening 169. A larger die is then positioned within the annular recess 181 and is locked in position on the die index ring 166 by the key 188 positioned in the keyway 190 aligned with a corresponding keyway of the larger die. To correspond with the die change, the tool holder 92 is disengaged from the swing arm 84 by operation of the locking device 90 and is replaced with a tool holder arranged to support a coordinating punching tool. Thus, the punching apparatus 10 provides a versatile tool punching and die support structure for performing a variety of punching operations.

FIGS. 4, 5 and 7 illustrate the punching apparatus 10 in punching position in which the swing arm 84 and attached tool holder 92 are vertically aligned with the ram housing 70 and the die 198 such that the axis of the punch ram 68 passes through the aligned axis or center lines of the punching tool 112 and the die 198.

To maintain the swing arm 84 rigidly secured to the upper arm portion 14 and in punching relationship with the ram housing 70, an annular opening 204 is provided in the ram housing intermediate portion 73 and is coaxially aligned with a bore 206 provided in the swing arm 84. A flanged sleeve member 208 having a bore 210 is positioned within the annular opening 204 and includes a flanged end portion 212. Bolts extending through the flanged end portion 212 threadedly engage the sleeve member 208 to the ram housing 70 within the opening 204. A bushing 214 is axially positioned within the bore 210 of the sleeve member 208 and has a lower end portion which is positioned in co-planar relation with the bottom surface of the ram housing 70.

A cylindrical sleeve 216 is positioned within the bore 206 of the swing arm 84. When the swing arm 84 is positioned in punching relationship relative to the ram housing 70, the sleeve member 216 is axially aligned with the bushing 214 to thereby provide a bore 218 for slidably receiving a pin 220. When the pin 220 is positioned within the bore 218, the swing arm 84 is engaged to the upper arm portion 14 and the tool holder 92 is securely retained in punching relationship with the ram punch 68 and the die 198.

The slidable movement of the pin member 220 into and out of engagement with the aligned bushing 214 and sleeve member 216 is accomplished by operation of a piston cylinder assembly generally designated by the numeral 222 positioned in the ram housing 70. The piston cylinder assembly 222, shown in detail in FIG. 7, includes a cylinder 224 having a piston and an extensible piston rod 226 attached thereto. The cylinder 224 is supported in the upper arm portion 14 by a bracket 228 which is fastened to the sleeve member 208. The extensible rod 226 is secured to the end portion of the pin 220 so that the piston cylinder assembly 222 is operable upon actuation to extend and retract the pin 220 in and out of the sleeve member 216 of the swing arm 84.

The piston cylinder assembly 222 is fluid actuated and is provided with a first fluid inlet 230 communicating with conduit 232. Air or hydraulic fluid is supplied under pressure to the head end of the piston through the inlet 230 to extend the pin 220 downwardly through the bushing 214 and into the sleeve member 216 aligned with the bushing 214. A second inlet 234 is provided at the lower end portion of the cylinder 224 and is connected to a conduit 236 which supplies fluid under pressure to the rod end of the piston. Fluid supplied to the rod end of the piston retracts the pin 220 from the sleeve member 216 and thereby releases the swing arm 84 from locking engagement with the frame upper arm portion 14 to permit the swing arm 84 to pivot with the shaft 76 into and out of punching position.

When the pin member 220 is in its fully extended position within the sleeve member 216, as illustrated in FIGS. 5–7, the lower end portion of the pin 220 engages a normally open electrical switch generally designated by the numeral 238 provided in the swing arm 84. The electrical switch 238 includes a roller 240 that is connected to the end of a plunger 242 slidably positioned within the swing arm 84. Thus, when the swing arm 84 is positioned in punching relationship with the ram housing 70, the pin 220 engages the roller 240 and completes an electric circuit which is energized by manually actuating a foot switch positioned on the floor at the front of the punching apparatus or by actuating the duplicating mechanism provided on the table 36, as explained hereinafter.

With the electrical switch 238 in closed position, as illustrated in FIGS. 5–7, the electric punch circuit is energized and a solenoid of a clutch valve (not shown) is actuated to transmit rotation from the motor 40 to the shaft 50 and thereby vertically reciprocate the ram punch 68 in the ram housing 70. Conversely, when the pin 220 is retracted from the sleeve member 216 to permit relative movement between the swing arm 84 and the upper arm portion 14, the pin member 220 is removed from contact with the roller 240 to thereby open the electrical switch 238, break the electric punch circuit and deenergize the solenoid of the clutch valve to render the punching apparatus inoperable.

During the punching operation, the pin 220 is continuously retained within the sleeve member 216 as shown in detail in FIG. 7, and thus the swing arm 84 is maintained in punching position relative to the ram housing 70. The pin 220 is retained in the sleeve member 216 by the constant supply of pressurized fluid from a reservoir (not shown) mounted on the press frame 12 to the first inlet 230 of the piston cylinder assembly 222 through the conduit 232. The fluid flows through the first inlet 230 and enters the cylinder 224 at the head end of the piston contained within the cylinder 224. In this manner, the rod 226 is extended outwardly from the cylinder 224 to retain the pin 220 within the sleeve member 216.

When it is desired to release the swing arm 84 from engagement with the upper arm portion 14 and pivot the swing arm 84 to a position removed from punching relationship, as shown in FIG. 1, for facilitating an exchange of the tool holder 92 or punching tool 112 and the die 198, fluid is diverted in the cylinder 224 from the inlet 230 to the inlet 234. By supplying fluid to the rod end of the piston, the rod 226 is returned to its retracted position within the cylinder 224 which, in turn, moves the pin 220 out of the bore 218 and into the upper arm member 14.

Figure 9:
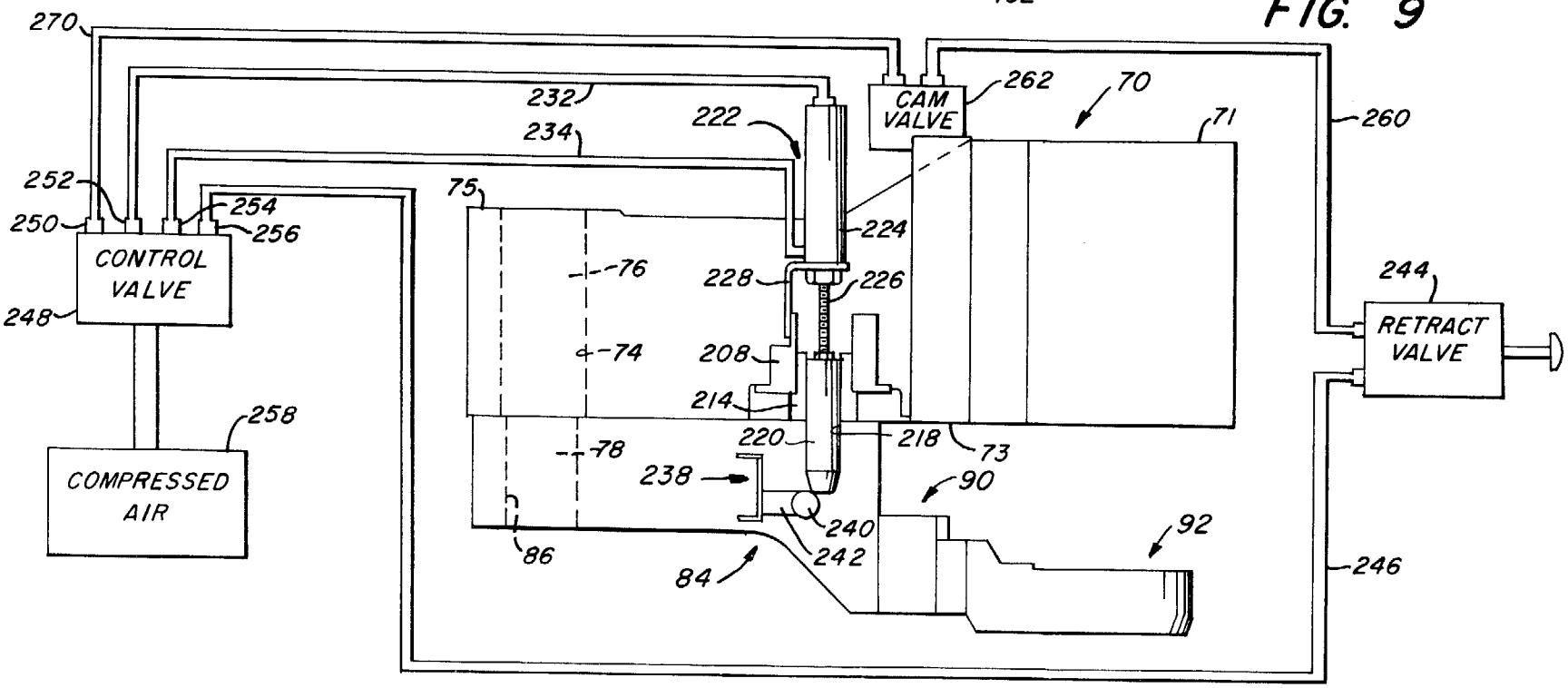
FIG. 9 is a schematic diagram of the pneumatic circuit employed for pivoting the swing arm and attached tool holder into and out of punching position beneath the ram punch.

Redirection of the fluid from the head end to the rod end of the piston within the cyinder 224 to retract the pin 220 from the bore 218 is accomplished by manually actuating a normally open retract valve 244 mounted below the worktable 37. The retract valve 224, as schematically illustrated in FIG. 9, is connected by a conduit 246 to a control valve 248 which is provided with a plurality of ports 250–256 for selectively directing the flow of pressurized fluid from a compressed air source 258. In operation, air is continuously supplied through the port 252 and conduit 232 in the head end of the piston within the cylinder 224 to maintain the pin 220 energized in the bore 218 of the swing arm 84. Supply of fluid to the rod end of the piston through port 254 and conduit 234, as stated above, retracts the pin 220 from engagement with the swing arm 84 to permit pivotal movement of the swing arm 84 and the attached tool holder 92 from a punching position to the position illustrated in FIG. 1, clear of the press frame 12.

When the swing arm 84 is engaged to the upper arm portion 14 in punching position, the control valve 248 continuously supplies compressed air from the source 258 to the port 256 and through the conduit 246, and through the open valve 244. Further, compressed air is directed from the retract valve 244 through conduit 260 to the held open valve 262, and through conduit 270 to control valve 248 to actuate control valve 248 so that compressed air is supplied to conduit 232 to extend the pin 220. The cam operated valve 262, is schematically illustrated in FIG. 9. The valve 262 is mounted to the upper arm portion 14 as illustrated in FIG. 4 and includes a vertically movable cam 264 carried on an actuator 266 secured to the upper arm portion 14.

The swing arm 84 is illustrated in punching position with the ram housing 70 in FIG. 4. In punching position cam 264 abuts the top surface of a bracket 268 mounted to the side of the swing arm 84 and the valve 262 is maintained in open position. Manually depressing the valve 244 closes the valve 244, and compressed air is temporarily directed from conduit 232 to conduit 234 to retract the pin 220 from the bore 218. The swing arm 84 is then released from engagement with the upper arm member 14 and is free to pivot with the shaft 76 from punching relation beneath the ram housing 70. The cam 264 moves out of abutting contact with the bracket 268 to permit the cam 264 to move vertically downwardly within the actuator 266 and thus close the valve 262. Closing the valve 262 maintains the supply of fluid from the control valve 248 through the port 254 and the conduit 234 to the rod end of the piston in the cylinder 224. In this manner, fluid is directed continuously to the rod end of the piston to retract the rod 226 in the cylinder 224, and thus retain the pin 220 within the bushing 214 of the ram housing 70.

As described hereinabove, when the pin 220 is displaced from contact with the electrical switch 238 in the swing arm 84, the punch circuit is broken. However, when the manual retract valve 244 is released, the valve 262 will remain closed as long as cam 264 is displaced from contact with the bracket 268. Thus, the pin 220 is maintained in retracted position and displaced from electrical contact with the switch 238. As long as the valve 262 remains closed, the reciprocal movement of the ram punch 68 cannot take place. This feature of breaking the punch circuit when the swing arm 84 is displaced from punching position provides a safe condition for exchanging the tool holder 92 or punch tool 112 in the tool holder 92 and corresponding die 198. Furthermore, unless the swing arm 84 and the upper arm portion 14 are properly aligned in the punching position, as illustrated in FIGS. 5–7, by the engagement of the pin 220 within the aligned bushing 214 and sleeve 216, the punching action will not take place.

When the tool change has been completed and the punching operation is to be commenced, the swing arm 84 is pivoted with the shaft 76 into underlying relationship with the ram housing 70, as shown in FIG. 4, so that the bracket 268 is returned to abutting contact with the cam 264. Contact of the cam 264 with the bracket 268 urges the cam upwardly relative to the actuator 266 to thereby open the valve 262. Opening the valve 262 diverts fluid from the conduit 234 to the conduit 232 and the head end of the piston within the cylinder 224. The rod 226 is extended outwardly from the cylinder 224 to, in turn, extend the pin 220 into the sleeve member 216 axially aligned with the bushing 214. The pin 220 engaged within the sleeve member 216 locks the swing arm 84 to the upper arm portion 14 and closes the switch 238 when it contacts the roller 240 as illustrated in FIGS. 5–7. The punching circuit is once again completed upon the closing of the electric switch 238 to permit energizing of the circuit and thus provide reciprocal movement of the ram punch 68.

The procedure for selectively orienting the punching tool 112 in the tool holder 92 with the die 198 supported in the table 37 at a predetermined desired angular position is illustrated in FIG. 6. Orientation of the punching tool 112 with the die 198 for punching tool and die combinations of circular as well as non-circular configurations is accomplished first by manually actuating the retract valve 244 to withdraw the pin 220 from the swing arm 84 so that the swing arm 84 is free to pivot with the shaft 76 relative to the upper arm portion 14. The swing arm 84 is then moved laterally to a displaced position clear of the press frame 12, as illustrated in FIG. 1. In this position, the punching tool 112, together with the stripping assembly 126, can be easily removed from the tool holder 92. The die 198, and the die adapter 178 can also be removed from the die index ring 166. Then, the guide bushing 122 is removed from its non-rotatable connection within the tool holder 92 by removing the key 120 from the annular recess 116 and the keyway 118. This frees guide bushing 122 for angular movement relative to the tool holder 92.

A guide indexing tool generally designated by the numeral 272 having a handle 273 and a longitudinal body portion 274 with a blade 276 provided at the end portion thereof is inserted within the guide bushing 122. A pin 278 projects outwardly from the body portion 274 and the handle 273 is rotated to position the pin 278 on the top portion of the guide bushing 122 as illustrated in phantom in FIG. 6.

With the guide index tool 272 positioned in the guide bushing of the tool holder 92, as described above, the die index ring 166 is released from engagement with the die support 160 by removing the key retaining screw 176 from the die pedestal 162. The key 174 may then be moved forwardly out of the keyway 172 of the die index ring 166. The key 174 is provided with a directional arrow which serves as reference point when angularly moving the die index ring 166 relative to the die pedestal 162. Finally, by removing the screws which connect the die index ring 166 to the die support 160 the die index ring 166 is freely rotatable upon the die support 160 relative to the die pedestal 162.

A die indexing tool generally designated by the numeral 280 and illustrated in FIG. 6 having a dial portion 282 and a body portion 284, is inserted within the annular recess 181 of the die index ring 166. The body portion 274 is provided with a vertically extending keyway 286 which is aligned with the keyway 190 of the die index ring 166 for receiving the key 188 so that the die indexing tool 280 is non-rotatably positioned relative to the die pedestal 162 and the die index ring 166.

With the die indexing tool 280 and the guide indexing tool 272 securely retained within the die pedestal 162 and the guide bushing 122 respectively, the swing arm 84 is returned to punching position as shown in FIGS. 4–7 beneath the upper arm portion 14 so that the bushing 214 and the sleeve 216 are aligned to permit engagement of the pin 220 within the bore 218. Thus, the punching tool 112 and the die 198 will be maintained in vertical alignment with the ram punch 68 by the pin 220 connecting the swing arm 84 to the upper arm portion 14. The guide indexing tool 272 is rotated until the pin 278 is positioned in overlying relationship with vertically extending keyway 286 of the guide bushing 122. The indexing tool body portion 274 is then lowered within the guide bushing 122 to the position illustrated by the solid lines in FIG. 6 until the bottom portion of the blade 276 engages horizontal slot 288 of the die index tool dial 282. With this arrangement, the die indexing tool 280, together with the guide bushing 122 and the die index ring 166 are locked as a unitary structure to permit the guide bushing 122 and the die index ring 166 to be rotatably moved as a unit to a selected angular setting within the die pedestal 162.

The periphery of the die indexing tool dial 282 is calibrated in degree increments (from 0° to 360°) to permit rotation of the unitary structure to a desired angular relationship relative to the reference mark provided on the key 174 retained in the keyway 170 of the die pedestal 162. Once the unitary structure has been moved to the desired angular position relative to the reference mark on the key 174, the guide bushing 122 and the die index ring 166 are secured to the tool holder 92 and the die support 160 respectively. The guide indexing tool 272 is then removed from the keyway 286 by the lifting tool 272 vertically upwardly until the pin 278 has cleared the keyway 286. The tool 272 is rotated to rest the pin 278 on the upper portion of the guide bushing 122, as indicated by the phantom lines in FIG. 6.

In the manner explained above, the pin 220 is withdrawn from the sleeve member 216 of the swing arm 84 into the ram housing 80 to permit the swing arm 84 and the attached tool holder 92 to be swung laterally from the punching position to a displaced position relative to the press frame 12. With the swing arm 84 in this position as shown in FIG. 1, the indexing tools 272 and 280 may be easily removed from the tool holder 92 and the die pedestal 162 respectively. The desired punching tool 112 with the stripping assembly 126 are inserted within the guide bushing 122 of the tool holder 92, and the key 120 is in locked position in the annular recess 116 and keyway 118. Correspondingly, the die 198 and die adapter 178, if appropriate, are positioned on the die support 160 and secured as explained above and illustrated in FIG. 6 to the die index ring 166 and the die pedestal 162. Once the desired punch tool and die have been inserted, the punching operation may be commenced.

The punching apparatus 10 also includes duplicating and gaging mechanisms, shown in FIGS. 1–3, positioned on the worktable 36 for perforating a workpiece in a pattern which is identical to the master pattern of a template 290. As illustrated in FIG. 1, the template 290 is positioned on the table surface 154 of the table 36. The template 290 is securely retained on the table surface 154 by suitable clamping devices.

The table surface 154 has a transverse opening 292 positioned in overlying relationship with horizontally extending arm portions 294 of the table supports 38, as illustrated in FIGS. 1 and 3. A flanged support member 296 is positioned on the arm 294 and is securely bolted to the table supports 38. The support member 296 includes a vertically extending pedestal portion upon which is rigidly mounted a transverse rail 298. A carriage 300 has a transverse bore 302 in which is positioned a bearing for slidably receiving the transverse rail 298. Thus, the carriage is arranged for transverse slidable movement on the rail 298.

The top portion of the carriage 300 is maintained in co-planar relationship with the table surface 154 as shown in FIG. 3. A spacer plate 304 is rigidly secured to the top surface of the carriage 300 and is thus arranged to move with the carriage 300 transversely above the plane of the table surface 154. A longitudinal gage bar 306 is bolted to the spacer plate 304 in such a manner that it is displaced from contact with the table surface 154. The thickness of the spacer plate 304 is equal to the difference in height between the table surface 152 and the table surface 154. Accordingly, the transverse movement of the carriage 300 on the rail 298 moves the gage bar 306 transversely relative to the table surfaces 152 and 154.

Referring to FIGS. 2 and 3, the end of the gage bar 306 adjacent the table surface 154 is provided with a roller bracket 308 which extends downwardly from the bottom surface of the gage bar 306 opposite the end of the table surface 154. A pair of rollers 310 are secured to the bracket 308 and are arranged to travel on the horizontal surfaces of a plate 312 that is secured to the bottom surface of the worktable 36. The opposite end portion of the gage bar 306 is slidably positioned on the table surface 152 by roller assemblies (not shown) which are secured to the bottom surface of the gage bar 306 and ride on table surface 152. With this arrangement, the gage bar 306 is arranged for transverse movement on the table surfaces 152 and 154 as the carriage 300 moves transversely on the rail 298.

A stiffener member 314 is mounted along the rear edge portion of the gage bar 306 as illustrated in FIG. 2 and rigidly supports a longitudinal guide bar 316. A duplicator arm 318 has a longitudinal bore in which is positioned a bearing 320 for slidably receiving the guide bar 316 to support the duplicator arm 318 above the table surface 154 and to permit longitudinal movement of the duplicator arm 318 on the gage bar 306. The duplicator arm 318 is additionally supported for longitudinal movement on the gage bar 306 by a roller assembly 322 secured to the duplicator arm 318 and arranged to ride along the upper surface of a rollerway 324 that is bolted to the gage bar 306.

A stylus support 326 projects forwardly from the duplicator arm 318 and is arranged to receive a stylus assembly generally designated by the numeral 328 in FIGS. 2 and 3. The duplicator arm 318 includes a horizontal flanged edge portion 332 adapted to receive suitable clamping devices (not shown) for locking the workpiece to the duplicator arm 318 so that the workpiece may be selectively moved with the duplicator arm 318 above the template 290. The duplicator arm 318 is arranged for longitudinal movement on the gage bar 306 which, in turn, is arranged for transverse movement with the carriage 300 on the transverse rail 298. Thus, the workpiece secured to the duplicator arm 318 and the stylus assembly 328 may be selectively moved longitudinally and transversely to any desired position above the table surface 154. Furthermore, the horizontal recess 18 in the press frame 12 between the upper and lower arm portions 14 and 16 accommodates movement of extremely large workpieces across the table surfaces 152 and 154.

The stylus assembly 328 is provided with a probe 330 which is retracted within the stylus support 326 when the duplicator arm 318 moves over the surface of the template 290. The probe 330 is manually extended to engage a desired hole in the template 290. The workpiece secured to the flanged edge portion 332 of the duplicator arm 318 is oriented with the punching tool 112 when the swing arm 84 is engaged to the upper arm portion 14 in punching position so that the perforation made in the workpiece will be positioned at a location therein which corresponds directly with the position of the pattern hole in the template 290.

A microswitch 334 provided on the duplicator arm 318, as illustrated in FIG. 3, is operably associated with the probe 330. When the probe 330 of the stylus assembly 328 is manually pushed downwardly into a selected pattern hole of the template 290, the microswitch 334 is actuated and transmits a signal which energizes the punch circuit to ultimately reciprocate the ram punch 68 and perforate the workpiece by the punch tool 112. In this fashion, the hole pattern of the template 290 will be duplicated in the workpiece by the combined punching action of the ram punch 68, the tool punch 112 and the die 198. Thus, in accordance with the practice of the present invention, it will be apparent that the advantages afforded by the manner in which the tool holder 92 is supported by the swing arm 84, the swing arm 84 engaged to the press frame 12 and the die 198 positioned in the table 37 enable the operator to quickly and efficiently make perforations in the workpiece of various shapes and sizes.

To facilitate gaging of the workpiece on the table surface 152 with respect to the punch tool 112 and the die 198, conventional micrometer bars 336 and 338, illustrated in FIG. 1, are mounted on the back edge of the gage bar 306 and on the side of the table surface 152 respectively by which X and Y axis measurements may be determined. The measuring bars 336 and 338 provide a numerical indication of the distance from the measuring bars to the center line of the punch tool 112 and die 198. In addition, direct reading gages such as tubular micrometers (not shown), well known in the art, may be provided on the measuring bars 336 and 338 to give precise settings within a thousandth of an inch for positioning the workpiece on the table surface 152 with respect to the punching tool and die. Roller drop stops and clamps (not shown) are associated with the micrometers to preserve the selective setting of the workpiece on the table surface 152 and rigidly secure the gage bar 306 to the table 37.

According to the provisions of the patent statutes, we have explained the principle, preferred construction and mode of operation of our invention and have illustrated and described what we now consider to represent its best embodiment. However, it should be understood that, within the scope of the appended claims, the invention may be practiced otherwise than as specifically illustrated and described.

We claim:

1. Punching apparatus comprising, a press frame, an elongated table horizontally mounted on said frame for supporting a workpiece, said press frame having an arm member positioned above the upper surface of said table and extending thereacross, said arm member spaced from said table forming an elongated recess therebetween for receiving the workpiece supported on said table, said arm member having a front end portion, a ram supported for relative vertical movement by said arm front end portion, power means for vertically reciprocating said ram toward and away from said table, means for supporting a die in vertical alignment with said ram, a tool support arm having a rear end portion and a front end portion, a tool holder secured to said tool support arm front end portion, connecting means for pivotally connecting said tool support arm rear end portion to said press frame arm member rearwardly of said press frame arm member front end portion between said press frame arm member and said table, said tool support arm and said tool holder laterally movable in a horizontal plane relative to said press frame arm member from a first position vertically aligned with said ram and said die supporting means to a second position displaced laterally from said ram and said frame arm member front end portion to permit replacement of said tool holder and tools in said tool holder, means for interchangeably locking said tool holder to said tool support arm, fluid actuated means for rigidly engaging said tool support arm and said tool holder to said press frame arm member and disengaging said tool support arm and said tool holder from said press frame arm member.

2. Punching apparatus as set forth in claim 1 in which said connecting means includes, a shaft rotatably secured to said press frame arm member and projecting vertically downwardly therefrom, and a first bore extending through the end portion of said tool support arm for non-rotatably receiving said shaft to permit angular movement of said tool support arm and said shaft relative to said press frame arm member from said first position to said second position.

3. Punching apparatus as set forth in claim 1 in which said fluid actuated means includes, a piston cylinder assembly supported on said press frame arm member, an extensible rod slidably positioned within said piston cylinder assembly, a pin member connected to the end portion of said rod for vertical movement therewith, said tool support arm provided with a second bore arranged to receive said pin member upon extension of said rod from said piston cylinder assembly when said tool support arm is positioned in said first position to rigidly engage said support arm to said press frame arm member, and means for actuating said piston cylinder assembly to extend said pin into said second bore.

4. Punching apparatus as set forth in claim 3 in which said means for actuating said piston cylinder assembly includes, a first inlet port in said piston cylinder assembly for receiving fluid under pressure to extend said rod from said piston cylinder assembly, and a second inlet port in said piston cylinder assembly for receiving fluid under pressure to retract said rod into said piston cylinder assembly.

5. Punching apparatus as set forth in claim 4 which includes, a fluid reservoir provided on said press frame, and means for selectively directing fluid under pressure from said reservoir to said first inlet port and said second inlet port to permit pivotal movement of said tool support arm between said first and second positions relative to said press frame arm member.

6. Punching apparatus as set forth in claim 4 which includes electrical switch means provided in said tool support arm for permitting selective actuation of said reciprocating means when contacted by said fluid actuated means.

7. Punching apparatus as set forth in claim 6 which includes, first valve means operatively associated with said fluid actuated means for releasing said tool support arm from engagement with said press frame arm member permitting pivotal movement of said tool support arm from said first position to said second position, and second valve means provided on said press frame arm member for maintaining said tool support arm disengaged from said press frame arm member to prevent actuation of said reciprocating means.

8. Punching apparatus as set forth in claim 7 in which said second valve means includes, a normally open valve communicating with said fluid actuated means and said first valve means, and an actuator for closing said normally open valve to disengage said tool support arm from said press frame arm member, said valve maintained in an open position by said actuator when said tool support arm is located in said first position.

9. Punching apparatus as set forth in claim 1 in which said reciprocating means includes, a crankshaft rotatably mounted in said press frame arm member and linked to said ram, and motor means drivingly connected to said crankshaft for producing rotation of said crankshaft and reciprocation of said ram only when said fluid actuated means rigidly engages said tool support arm to said press frame arm member.

10. Punching apparatus as set forth in claim 1 in which said ram includes, an eccentric cam, means for transmitting torque from said reciprocating means to said eccentric cam, a ram housing mounted to the front portion of said upper arm portion and having a bore vertically aligned with said die supporting means, a solid cylindrical member slidably positioned in said ram housing bore, said cylindrical member having a striker plate secured to the bottom portion thereof, and means for linking said cylindrical member to said eccentric cam such that rotation of said eccentric cam reciprocates said cylindrical member to deliver an impact blow to the punch tool by said striker plate when said fluid actuated means rigidly engages said tool support arm to said press frame arm member.

11. Punching apparatus as set forth in claim 1 in which said die supporting means includes, said table having an opening coaxially aligned with said ram, a die block positioned beneath said opening and rigidly secured to said press frame, an annular pedestal positioned in said opening and non-rotatably mounted on said die block, said pedestal having an axial bore extending therethrough and coaxially aligned with said opening, an annular support member positioned on said die block within saaid pedestal bore, said support member having a bore coaxially aligned with said pedestal bore, an annular ring member positioned within said pedestal bore and mounted on said support member for relative angular movement with respect to said pedestal, said annular ring member having an axial bore aligned with said pedestal bore and an upper annular recess for receiving a die, releasably detachable means for rigidly securing said ring member to said pedestal within said pedestal bore at a predetermined angular relationship with respect to said pedestal, and means for non-rotatably receiving the die within said annular recess of said ring member to maintain the die in vertical alignment with said tool support arm located in said first position when engaged to said press frame arm member by said fluid actuated means.

12. Punching apparatus as set forth in claim 11 which includes, adapter means non-rotatably positioned within said ring member annular recess for supporting a die in said table when said tool support arm is located in said first position.

13. Punching apparatus as set forth in claim 1 which includes, means for selectively orienting the angular position of said tool holder with said die supporting means.

14. Punching apparatus as set forth in claim 13 in which said orienting means includes, said tool holder having a rotatable guide bushing, said die supporting means having a rotatable die index ring, a guide indexing tool positioned in said guide bushing at a predetermined angular relationship therewith, a die indexing tool rotatably positioned on said die index ring and arranged to receive said guide indexing tool at a predetermined angular relationship therewith, and means for non-rotatably retaining said guide bushing in said tool holder at a predetermined angular position and said die index ring in said die supporting means at a predetermined angular position directly relating to the angular position of said guide bushing in said tool holder.

15. Punching apparatus comprising, a press frame, an elongated table horizontally mounted on said frame for supporting a workpiece, said press frame having an arm member positioned above the upper surface of said table and extending thereacross, said arm member spaced from said table forming an elongated recess therebetween for receiving the workpiece supported on said table, said arm member having a front end portion, a ram supported for relative vertical movement by said arm front end portion, power means for vertically reciprocating said ram toward and away from said table, means for supporting a die in vertical alignment with said ram, a tool support arm having a rear end portion and a front end portion, a tool holder secured to said tool support arm front end portion, connecting means for pivotally connecting said tool support arm rear end portion to said press frame arm member rearwardly of said press frame arm member front end portion between said press frame arm member and said table, said tool support arm and said tool holder laterally movable in a horizontal plane relative to said press frame arm member from a first position vertically aligned with said ram and said die supporting means to a second position displaced laterally from said ram and said frame arm member front end portion to permit replacement of said tool holder and tools in said tool holder, electrical switch means provided in said tool support arm for permitting selective actuation of said reciprocating means when contacted by said fluid actuated means, first valve means operatively associated with said fluid actuated means for releasing said tool support arm from engagement with said press frame arm member permitting pivotal movement of said tool support arm from said first position to said second position, second valve means provided on said press member for maintaining said tool support arm disengaged from said press frame arm member to prevent actuation of said reciprocating means, said second valve including a normally open valve communicating with said fluid actuator means and said first valve means, an actuator for closing said normally open valve to disengage said tool support arm from said press frame arm member, and said valve arranged to be maintained in an open position by said actuator when said tool support arm is located in said first position.

16. Punching apparatus as set forth in claim 15 in which said connecting means includes, a shaft rotatably secured to said press frame arm member and projecting vertically downwardly therefrom, and a first bore extending through the end portion of said tool support arm for non-rotatably receiving said shaft to permit angular movement of said tool support arm and said shaft relative to said press frame arm member from said first position to said second position.

17. Punching apparatus as set forth in claim 15 which includes, means for interchangeably locking said tool holder to said tool support arm.

18. Punching apparatus as set forth in claim 15 which includes, fluid actuated means for rigidly engaging said tool support arm and said tool holder to said press frame arm member and disengaging said tool support arm and said tool holder from said press frame arm member.

19. Punching apparatus as set forth in claim 15 in which said fluid actuated means includes, a piston cylinder assembly supported on said press frame arm member, an extensible rod slidably positioned within said piston cylinder assembly, a pin member connected to the end portion of said rod for vertical movement therewith, said tool support arm provided with a second bore arranged to receive said pin member upon extension of said rod from said piston cylinder assembly when said tool support arm is positioned in said first position to rigidly engage said support arm to said press frame arm member, and means for actuating said piston cylinder assembly to extend said pin into said second bore.

20. Punching apparatus as set forth in claim 19 in which said means for actuating said piston cylinder assembly includes, a first inlet port in said piston cylinder assembly for receiving fluid under pressure to extend said rod from said piston cylinder assembly, and a second inlet port in said piston cylinder assembly for receiving fluid under pressure to retract said rod into said piston cylinder assembly.

21. Punching apparatus as set forth in claim 20 which includes, a fluid reservoir provided on said press frame, and means for selectively directing fluid under pressure from said reservoir to said first inlet port and said second inlet port to permit pivotal movement of said tool support arm between said first and second positions relative to said press frame arm member.

22. Punching apparatus as set forth in claim 15 in which said reciprocating means includes, a crankshaft rotatably mounted in said press frame arm member and linked to said ram, and motor means drivingly connected to said crankshaft for producing rotation of said crankshaft and reciprocation of said ram only when said fluid actuated means rigidly engages said tool support arm to said press frame arm member.

23. Punching apparatus as set forth in claim 15 in which said ram includes, an eccentric cam, means for transmitting torque from said reciprocating means to said eccentric cam, a ram housing mounted to the front portion of said upper arm portion and having a bore vertically aligned with said die supporting means, a solid cylindrical member slidably positioned in said ram housing bore, said cylindrical member having a striker plate secured to the bottom portion thereof, and means for linking said cylindrical member to said eccentric cam such that rotation of said eccentric cam reciprocates said cylindrical member to deliver an impact blow to the punch tool by said striker plate when said fluid actuated means rigidly engages said tool support arm to said press frame arm member.

24. Punching apparatus as set forth in claim 15 in which said die supporting means includes, said table having an opening coaxially aligned with said ram, a die block positioned beneath said opening and rigidly secured to said press frame, an annular pedestal positioned in said opening and non-rotatably mounted on said die block, said pedestal having an axial bore extending therethrough and coaxially aligned with said opening, an annular support member positioned on said die block within said pedestal bore, said support member having a bore coaxially aligned with said pedestal bore, an annular ring member positioned within said pedestal bore and mounted on said support member for relative angular movement with respect to said pedestal, said annular ring member having an axial bore aligned with said pedestal bore and an upper annular recess for receiving a die, releasably detachable means for rigidly securing said ring member to said pedestal within said pedestal bore at a predetermined angular relationship with respect to said pedestal, and means for non-rotatably receiving the die within said annular recess of said ring member to maintain the die in vertical alignment with said tool support arm located in said first position when engaged to said press frame arm member by said fluid actuated means.

25. Punching apparatus as set forth in claim 24 which includes, adapter means non-rotatably positioned within said ring member annular recess for supporting a die in said table when said tool support arm is located in said first position.

26. Punching apparatus as set forth in claim 16 which includes, means for selectively orienting the angular position of said tool support portion with said die supporting means.

27. Punching apparatus as set forth in claim 26 in which said orienting means includes, said tool support portion having a rotatable guide bushing, said die supporting means having a rotatable die index ring, a guide indexing tool positioned in said guide bushing at a predetermined angular relationship therewith, a die indexing tool rotatably positioned on said die index ring and arranged to receive said guide indexing tool at a predetermined angular relationship therewith, and means for non-rotatably retaining said guide bushing in said tool support portion at a predetermined angular position and said die index ring in said die supporting means at a predetermined angular position directly relating to the angular position of said guide bushing in said tool support portion.

28. Punching apparatus comprising, a press frame, an elongated table horizontally mounted on said frame for supporting a workpiece, said press frame having an arm member positioned above the upper surface of said table and extending thereacross, said arm member spaced from said table forming an elongated recess therebetween for receiving the workpiece supported on said table, said arm member having a front end portion, a ram supported for relative vertical movement by said arm front end portion, power means for vertically reciprocating said ram toward and away from said table, means for supporting a die in vertical alignment with said ram, a tool support arm having a rear end portion and a front end portion, a tool holder secured to said tool support arm front end portion, connecting means for pivotally connecting said tool support arm rear end portion to said press frame arm member rearwardly of said press frame arm member front end portion between said press frame arm member and said table, said tool support arm and said tool holder laterally movable in a horizontal plane relative to said press frame arm member from a first position vertically aligned with said ram and said die supporting means to a second position displaced laterally from said ram and said frame arm member front end portion to permit replacement of said tool holder and tools in said tool holder, means for selectively orienting the angular position of said tool support portion with said die supporting means, said orienting means having a rotatable guide bushing in said tool portion, said die supporting means having a rotatable die index ring, a guide indexing tool positioned in said guide bushing at a predetermined angular relationship therewith, a die indexing tool rotatably positioned on said die index ring and arranged to receive said guide indexing tool at a predetermined angular relationship therewith, and means for non-rotatably retaining said guide bushing in said tool support portion at a predetermined angular position and said die index ring in said die supporting means at a predetermined angular position directly relating to the angular position of said guide bushing in said tool support portion.

29. Punching apparatus as set forth in claim 28 in which said connecting means includes, a shaft rotatably secured to said press frame arm member and projecting vertically downwardly therefrom, and a first bore extending through the end portion of said tool support arm for non-rotatably receiving said shaft to permit angular movement of said tool support arm and said shaft relative to said press frame arm member from said first position to said second position.

30. Punching apparatus as set forth in claim 28 which includes, means for interchangeably locking said tool holder to said tool support arm.

31. Punching apparatus as set forth in claim 28 which includes, fluid actuated means for rigidly engaging said tool support arm and said tool holder to said press frame arm member and disengaging said tool support arm and said tool holder from said press frame arm member.

32. Punching apparatus as set forth in claim 31 in which said fluid actuated means includes, a piston cylinder assembly supported on said press frame arm member, an extensible rod slidably positioned within said piston cylinder assembly, a pin member connected to the end portion of said rod for vertical movement therewith, said tool support arm provided with a second bore arranged to receive said pin member upon extension of said rod from said piston cylinder assembly when said tool support arm is positioned in said first position to rigidly engage said support arm to said press frame arm member, and means for actuating said piston cylinder assembly to extend said pin into said second bore.

33. Punching apparatus as set forth in claim 32 in which said means for actuating said piston cylinder assembly includes, a first inlet port in said piston cylinder assembly for receiving fluid under pressure to extend said rod from said piston cylinder assembly, and a second inlet port in said piston cylinder assembly for receiving fluid under pressure to retract said rod into said piston cylinder assembly.

34. Punching apparatus as set forth in claim 33 which includes, a fluid reservoir provided on said press frame, and means for selectively directing fluid under pressure from said reservoir to said first inlet port and said second inlet port to permit pivotal movement of said tool support arm between said first and second positions relative to said press frame arm member.

35. Punching apparatus as set forth in claim 28 which includes, electrical switch means provided in said tool support arm for permitting selective actuation of said reciprocating means when contacted by said fluid actuated means.

36. Punching apparatus as set forth in claim 35 which includes, first valve means operatively associated with said fluid actuated means for releasing said tool support arm from engagement with said press frame arm member permitting pivotal movement of said tool support arm from said first position to said second position, and second valve means provided on said press frame arm member for maintaining said tool support arm disengaged from said press frame arm member to prevent actuation of said reciprocating means.

37. Punching apparatus as set forth in claim 36 in which said second valve means includes, a normally open valve communicating with said fluid actuated means and said first valve means, and an actuator for closing said normally open valve to disengage said tool support arm from said press frame arm member, said valve maintained in an open position by said actuator when said tool support arm is located in said first position.

38. Punching apparatus as set forth in claim 28 in which said reciprocating means includes, a crankshaft rotatably mounted in said press frame arm member and linked to said ram, and motor means drivingly connected to said crankshaft for producing rotation of said crankshaft and reciprocation of said ram only when said fluid actuated means rigidly engages said tool support arm to said press frame arm member.

39. Punching apparatus as set forth in claim 28 in which said ram includes, an eccentric cam, means for transmitting torque from said reciprocating means to said eccentric cam, a ram housing mounted to the front portion of said upper arm portion and having a bore vertically aligned with said die supporting means, a solid cylindrical member slidably positioned in said ram housing bore, said cylindrical member having a striker plate secured to the bottom portion thereof, and means for linking said cylindrical member to said eccentric cam such that rotation of said eccentric cam reciprocates said cylindrical member to deliver an impact blow to the punch tool by said striker plate when said fluid actuated means rigidly engages said tool support arm to said press frame arm member.

40. Punching apparatus as set forth in claim 28 in which said die supporting means includes, said table having an opening coaxially aligned with said ram, a die block positioned beneath said opening and rigidly secured to said press frame, an annular pedestal positioned in said opening and non-rotatably mounted on said die block, said pedestal having an axial bore extending therethrough and coaxially aligned with said opening, an annular support member positioned on said die block within said pedestal bore, said support member having a bore coaxially aligned with said pedestal bore, an annular ring member positioned within said pedestal bore and mounted on said support member for relative angular movement with respect to said pedestal, said annular ring member having an axial bore aligned with said pedestal bore and an upper annular recess for receiving a die, releasably detachable means for rigidly securing said ring member to said pedestal within said pedestal bore at a predetermined angular relationship with respect to said pedestal, and means for non-rotatably receiving the die within said annular recess of said ring member to maintain the die in vertical alignment with said tool support arm located in said first position when engaged to said press frame arm member by said fluid actuated means.

41. Punching apparatus as set forth in claim 40 which includes, adapted means non-rotatably positioned within said ring member annular recess for supporting a die in said table when said tool support arm is located in said first position.

* * * * *